US006164247A

United States Patent [19]

Iwasaki et al.

[11] Patent Number: 6,164,247

[45] Date of Patent: Dec. 26, 2000

[54] INTERMEDIATE FLUID TYPE VAPORIZER, AND NATURAL GAS SUPPLY METHOD USING THE VAPORIZER

[75] Inventors: Masahide Iwasaki, Osaka; Shinji Egashira, Takasago; Tsuyoshi Oda, Kobe; Kazuhiko Asada; Kuniteru Sugino, both of Takasago, all of Japan

[73] Assignee: Kabushiki Kaishi Kobe Seiko Sho, Kobe, Japan

[21] Appl. No.: 09/493,271

[22] Filed: Jan. 28, 2000

[30] Foreign Application Priority Data

Feb. 4, 1999 [JP] Japan ..... 11-027642

[51] Int. Cl.[7] ..... F01K 27/00

[52] U.S. Cl. ..... 122/31.1; 60/641.1; 60/641.7

[58] Field of Search ..... 122/31.1, 32, 33; 60/641.7, 641.1, 514

[56] References Cited

U.S. PATENT DOCUMENTS 4,170,115 10/1979 Ooka et al. ..... 122/33
4,417,951 11/1983 Stanisic et al. ..... 122/492
5,186,822 2/1993 Tzong et al. ..... 60/499
6,089,022 7/2000 Zednik et al. ..... 60/641.7

*Primary Examiner*—Denise L. Ferensic
*Assistant Examiner*—Gregory A. Wilson
*Attorney, Agent, or Firm*—Reed Smith Hazel & Thomas LLP

[57] ABSTRACT

An intermediate fluid type vaporizer has an intermediate fluid evaporator for containing an intermediate fluid. The intermediate fluid evaporator includes heat source tubes for evaporating the intermediate fluid, and a low-temperature liquid evaporating section for evaporating a low-temperature liquid by exchanging heat between the low-temperature liquid and the evaporated intermediate fluid. In the intermediate fluid evaporator, members for dividing the intermediate fluid, and cover plates for covering both ends of the intermediate fluid level from above are provided to prevent the intermediate fluid level from changing due to the shaking of the intermediate fluid evaporator itself. This vaporizer and an LNG tank are mounted on a ship so as to vaporize LNG in the ship and to supply the LNG to an onshore consumer.

22 Claims, 5 Drawing Sheets

INTERMEDIATE FLUID TYPE VAPORIZER, AND NATURAL GAS SUPPLY METHOD USING THE VAPORIZER

BACKGROUND OF THE INVENTION

1. Field of the Invention

The present invention relates to an intermediate fluid type vaporizer that heats and vaporizes low-temperature liquid, such as liquefied natural gas (hereinafter referred to as "LNG"), by using an intermediate fluid such as propane. The present invention also relates to a natural gas supply method using the vaporizer.

2. Description of the Related Art

As a means for continuously vaporizing low-temperature liquid, such as LNG, in a compact structure, an intermediate fluid type vaporizer is known which uses an intermediate fluid in addition to a heat source fluid (Japanese Unexamined Patent Publication No. 53-5207, etc.).

FIG. 5 shows an LNG vaporizer as an example of the intermediate fluid type vaporizer. The LNG vaporizer comprises an intermediate fluid evaporator E1, an LNG evaporator E2, and a natural gas (hereinafter referred to as "NG") heater E3. The LNG vaporizer further comprises an inlet channel 10, multiple heat source tubes 12, an intermediate channel 14, multiple heat source tubes 16, and an outlet channel 18 that are provided, in that order, so as to form a path through which a heat source fluid (sea water in this example) flows. The heat source tubes 12 are disposed in the NG heater E3, and the heat source tubes 16 are disposed in the intermediate fluid evaporator E1. The intermediate fluid evaporator E1 contains an intermediate fluid (e.g., propane) 17 whose boiling point is lower than that of sea water serving as the heat source fluid.

The LNG evaporator E2 comprises an inlet channel 22 and an outlet channel 24 that are divided by a partition plate 20, and multiple heat transfer tubes 23 that link both the channels 22 and 24. The heat transfer tubes 23 are approximately U-shaped, and project above the intermediate fluid evaporator E1. The outlet channel 24 is connected to the inside of the NG heater E3 via an NG piping 26.

In such a vaporizer, sea water serving as the heat source fluid passes through the inlet channel 10, the heat source tubes 12, the intermediate channel 14, and the heat source tubes 16, and reaches the outlet channel 18. While passing through the heat source tubes 16, the sea water exchanges heat with the intermediate fluid 17 in the intermediate fluid evaporator E1, thereby evaporating the intermediate fluid 17.

On the other hand, LNG to be vaporized is introduced from the inlet channel 22 into the heat transfer tubes 23. The LNG in the heat transfer tubes 23 and the evaporated intermediate fluid 17 in the intermediate fluid evaporator E1 exchanges heat with each other, and the intermediate fluid 17 is thereby condensed. By receiving the heat of condensation, the LNG is evaporated into NG inside the heat transfer tubes 23. The NG is introduced from the outlet channel 24 into the NG heater E3 through the NG piping 26, is further heated by heat exchange with sea water that flows through the heat source tubes 12 in the NG heater E3, and is then supplied to a consumer.

Therefore, this intermediate fluid type vaporizer allows LNG to be continuously vaporized by repeating evaporation and condensation of the intermediate fluid 17.

The above-described intermediate fluid type vaporizer is more compact and has a lower profile than an open-rack type vaporizer. So, for example, even when there are no LNG supply facilities on the land, LNG can be vaporized off shore and supplied to an onshore consumer by installing both this vaporizer and an LNG tank on a ship or a barge plant floating on the sea. When the above-described intermediate fluid type vaporizer is installed on the sea, however, the entire vaporizer shakes together with the ship or the like due to waves or the like, and the level of the intermediate fluid 17 in the intermediate fluid evaporator E1 greatly changes, which may produce adverse effects on vaporization ability. Specifically, the adverse effects are as follows:

A) Exposure of Heat Source Tubes 16

In a case in which the intermediate fluid evaporator E1 shakes to tilt in the transverse direction (in the widthwise direction nearly orthogonal to the axial direction of the heat source tubes 16), as shown in FIG. 6A, or in a case in which the intermediate fluid evaporator E1 shakes to tilt in the longitudinal direction (in the lengthwise direction nearly parallel to the axial direction of the heat source tubes 16), as shown in FIG. 6C, an intermediate fluid level 17*a* greatly tilts relative to the evaporator E1, and this may incur a risk that some of the heat source tubes 16 will be exposed above the level 17*a*. In such exposed portions, heat exchange between the intermediate fluid 17 and the heat source fluid is impossible, which significantly impairs vaporization ability.

B) Surface Wetting of Heat Transfer Tubes 23

When the shaking in the longitudinal or transverse direction becomes large, there is a risk that the heat transfer tubes 23 of the LNG evaporator E2 will be wetted due to a wave 17*b* of the intermediate fluid 17 striking the LNG evaporator E2, as shown in FIG. 6B, or because the end of the LNG evaporator E2 is soaked in the intermediate fluid 17, as shown in FIG. 6C. Such surface wetting significantly impairs the condensation ability of the intermediate fluid 17 on the surfaces of the heat transfer tubes 23.

SUMMARY OF THE INVENTION

In view of such circumstances, an object of the present invention is to provide an intermediate fluid type vaporizer that is able to maintain good vaporization ability even when installed under conditions where an intermediate fluid evaporator is shaken, and to provide an NG supply method using the vaporizer.

In order to achieve the above object, according to one aspect of the present invention, there is provided an intermediate fluid type vaporizer having an intermediate fluid evaporator for containing an intermediate fluid, the intermediate fluid evaporator including a heat source tube for evaporating the intermediate fluid by exchanging heat between a heat source fluid and the intermediate fluid, and a low-temperature liquid evaporating section for evaporating a low-temperature liquid by exchanging heat between the low-temperature liquid and the evaporated intermediate fluid, wherein the intermediate fluid evaporator further includes means for preventing the level of the intermediate fluid in the intermediate fluid evaporator from changing due to shaking of the intermediate fluid evaporator itself.

By using this construction, even when the intermediate fluid evaporator itself shakes, the level of the intermediate fluid therein is prevented from changing due to the shaking. Therefore, it is possible to prevent exposure of the heat source tube and surface wetting of the low-temperature liquid evaporating section, which result from the level change, and to thereby maintain good vaporization ability.

A partition member for dividing the intermediate fluid that remains in the intermediate fluid evaporator may be provided in the intermediate fluid evaporator. In this case, the intermediate fluid is restrained from moving inside the intermediate fluid evaporator due to the tilting of the intermediate fluid evaporator. As a result, the level change of the intermediate fluid is prevented.

Preferably, the partition member is placed within a height range including at least the level of the intermediate fluid in the intermediate fluid evaporator. This can prevent the level change more effectively.

Preferably, the partition member divides the intermediate fluid, which remains in the intermediate fluid evaporator, in the widthwise direction nearly orthogonal to the axial direction of the heat source tube. In this case, the level change in the dividing direction can be prevented. Therefore, the vaporizer becomes more resistant to the shaking and tilting of the intermediate fluid evaporator in the dividing direction.

The partition member may be provided at a plurality of positions arranged in the dividing direction. This further increases the effect of preventing the level change.

Preferably, the partition member divides the intermediate fluid, which remains in the intermediate fluid evaporator, in the lengthwise direction nearly parallel to the axial direction of the heat source tube. In this case, the level change in the dividing direction is also prevented, and the vaporizer becomes more resistant to the shaking and tilting of the intermediate fluid evaporator in the dividing direction.

The partition member may be provided at a plurality of positions arranged in the dividing direction. This further increases the level change preventing effect.

Support plates for commonly holding a plurality of parallel heat source tubes may be disposed at a plurality of positions arranged in the lengthwise direction nearly parallel to the axial direction of the heat source tubes so as to extend to a position higher than the level of the intermediate fluid in the intermediate fluid evaporator. In this case, the support plates can be effectively utilized as partition members for preventing the level change.

A lattice-shaped partition member may be provided to divide the intermediate fluid, which remains in the intermediate fluid evaporator, both in the lengthwise direction nearly parallel to the axial direction of the heat source tubes, and in the widthwise direction nearly orthogonal to the axial direction. In this case, it is possible to construct a vaporizer that is resistant to shaking in all directions, and that is hardly restricted by the direction of placement.

Preferably, the partition member is placed within a height range including at least the level of the intermediate fluid in the intermediate fluid evaporator. This further increases the level change preventing effect.

A covering member may be provided in the intermediate fluid evaporator to cover both ends of the level of the intermediate fluid that remains in the intermediate fluid evaporator. This makes it possible to prevent waves from rising from both ends of the level, and to thereby prevent surface wetting due to striking of waves against the heat transfer tubes.

As described above, since the vaporizer of the present invention can maintain good vaporization in spite of shaking thereof, it is particularly suitable as a vaporizer to be placed on a ship or a barge plant installed on the water. Even when there are no liquefied natural gas vaporizing facilities on the land, natural gas can be rapidly supplied from the ship to a consumer by mounting such a vaporizer together with a liquefied natural gas tank on a ship or on a barge plant, and supplying liquefied natural gas contained in the liquefied natural gas tank to the land after vaporizing the liquefied natural gas by the intermediate fluid type vaporizer.

Further objects, features, and advantages of the present invention will be apparent from the following description of the preferred embodiments with reference to the attached drawings.

DESCRIPTION OF THE PREFERRED EMBODIMENT

Figure 5:
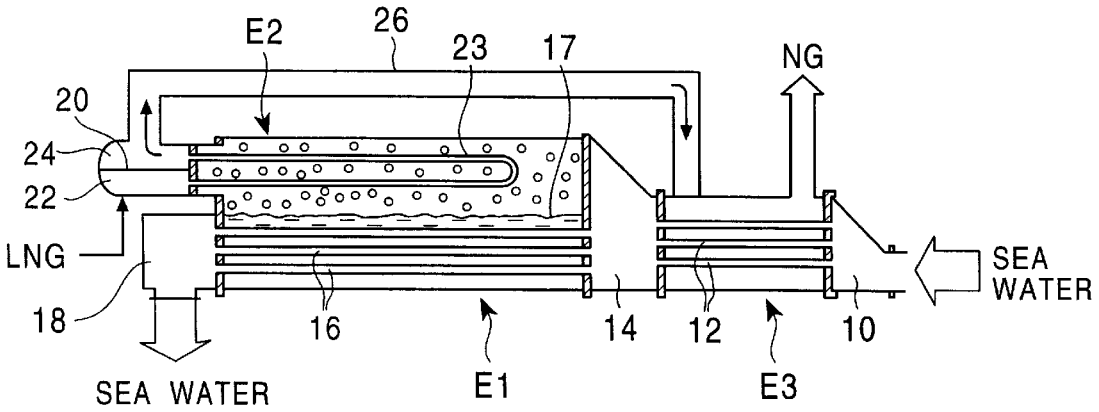
FIG. 5 PRIOR ART
FIG. 5 is a front sectional view showing the overall configuration of a general intermediate fluid type vaporizer.

A preferred embodiment of the present invention will be described below with reference to FIGS. 1 to 4. The overall basic configuration of a vaporizer in this embodiment is equivalent to that shown in FIG. 5, and therefore, a description thereof is omitted. This description places emphasis on the internal structure of an intermediate fluid evaporator E1.

As shown in FIGS. 1, 2, 3A, 3B, and 3C, the intermediate fluid evaporator E1 of this embodiment includes a cylindrical shell 30 extending parallel to heat source tubes 16, and tubesheets 32 fixed to both ends of the shell 30, in which an intermediate fluid 17 is contained. To both the tubesheets 32, both ends of the heat source tubes 16 are fixed to penetrate therethrough.

In the lower part of the intermediate fluid evaporator E1, support plates 34 stand at a plurality of positions that are arranged in the lengthwise direction nearly in parallel with the axial direction of the heat source tubes 16. Middle portions of the heat source tubes 16 are supported by the support plates 34 to penetrate therethrough.

Figure 1:
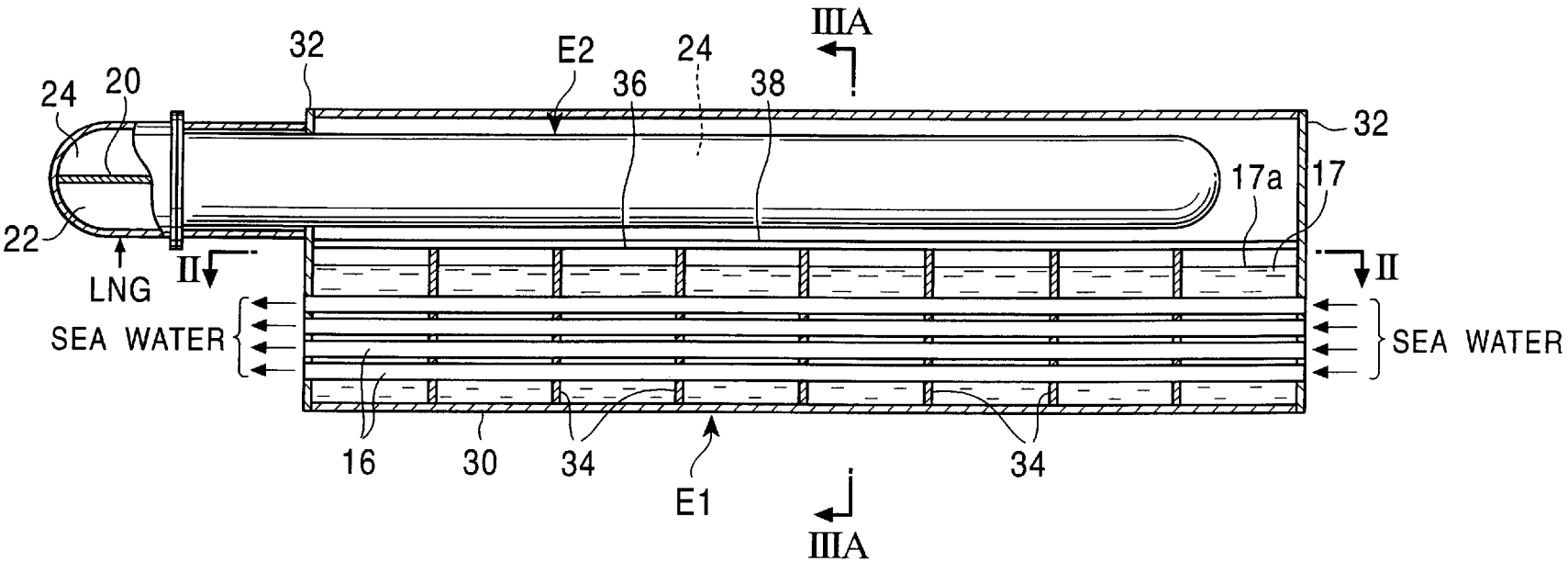
FIG. 1 is a front sectional view showing the principal part of an intermediate fluid type vaporizer according to an embodiment of the present invention.
Figure 3A:
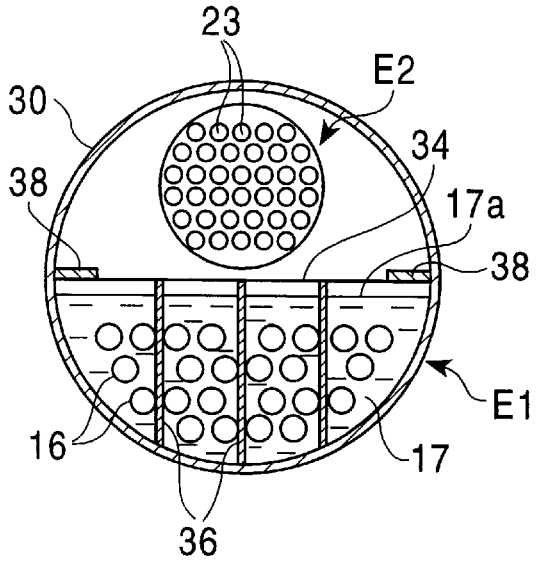
FIGS. 3A, 3B, and 3C are sectional views taken along line IIIA—IIIA of FIG. 1, respectively showing a state in which an intermediate fluid evaporator is stationary, a state in which the intermediate fluid evaporator is transversely tilted, and a state in which a support plate is disposed at a lower position than the fluid level in the intermediate fluid evaporator.

This vaporizer is characterized in that the height of the support plates 34 is set to be large so that the top ends thereof are higher than a level 17*a* of the intermediate fluid 17 in a state in which the level 17*a* is stationary (i.e., a state in which the vaporizer itself, although being driven, does not shake, but remains stationary; a state shown in FIGS. 1 and 3A. There are small clearances between through holes formed in the support plates 34 and the heat source tubes 16 passing through the through holes, which allow the intermediate fluid 17 to move slightly back and forth through the support plates 34.

Figure 2:
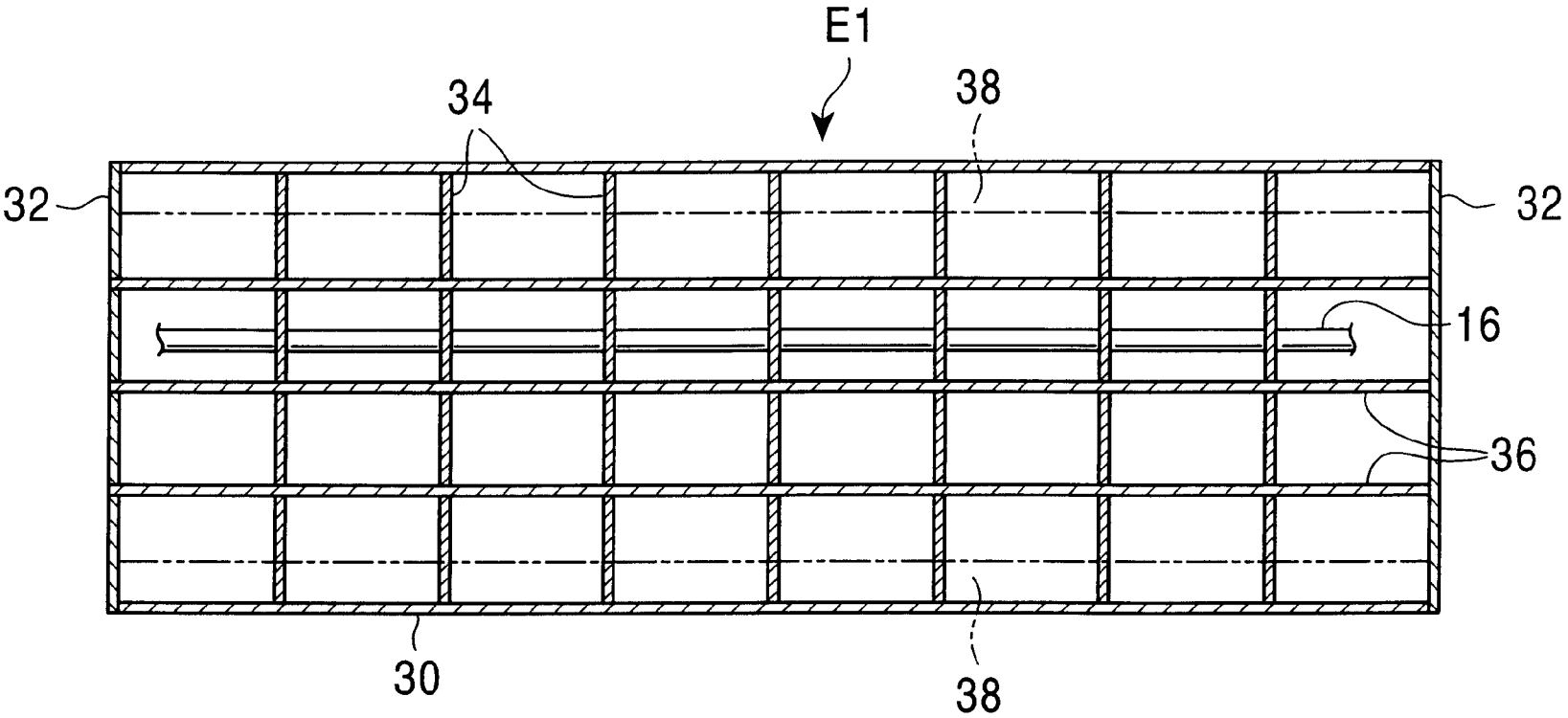
FIG. 2 is a sectional view taken along line II—II of FIG. 1.
Figure 3B:
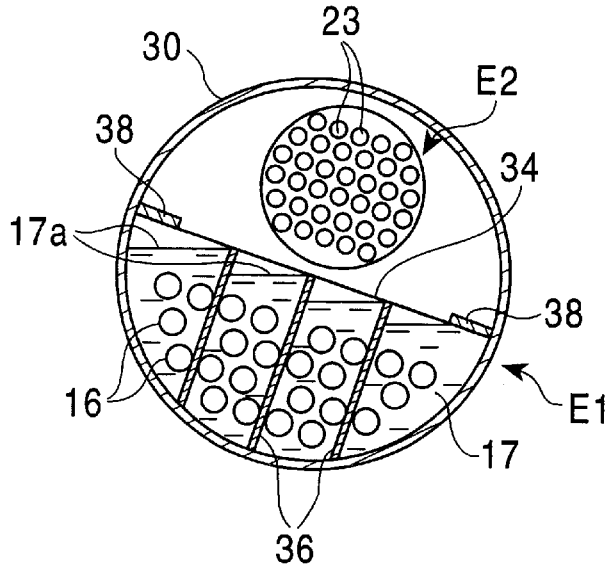

In this vaporizer, baffles (partition members) 36 shown in FIGS. 2, 3A, and 3B also stand at a plurality of positions (three positions in the illustration) that are arranged in the widthwise direction nearly orthogonal to the above-described axial direction. The baffles 36 extend in the longitudinal direction nearly in parallel with the axial direction, and intersect the support plates 34 at approximately right angles to form a lattice. The height of these baffles 36 is also set to be large so that the top ends thereof are higher than the stationary level 17*a*. The baffles 36 have small through holes, through which the intermediate fluid 17 is allowed to move to the right and left sides of the baffles 36.

Cover plates (covering members) 38 are fixed to the right and left inner side faces of the shell 30 so as to project inward. These cover plates 38 are placed higher than the stationary level 17*a* of the intermediate fluid 17 so that they cover the right and left ends of the level 17*a* from above.

Figure 6A:
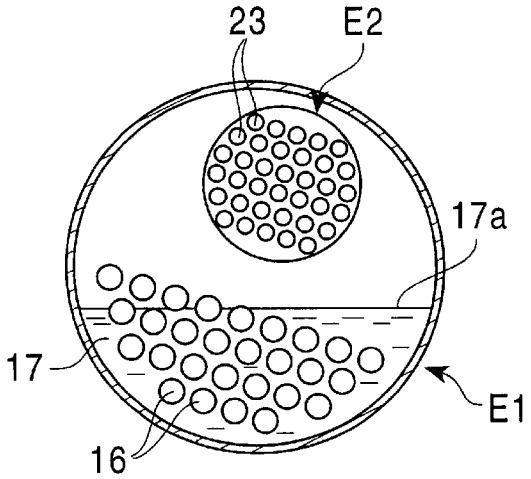
FIG. 6A PRIOR ART
FIGS. 6A, 6B, and 6C are sectional views illustrating problems caused when the vaporizer shown in FIG. 5 is shaken.
Figure 6B:
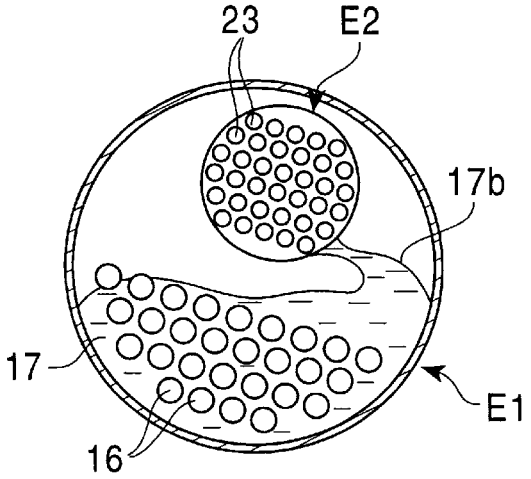
FIG. 6B PRIOR ART
Figure 6C:
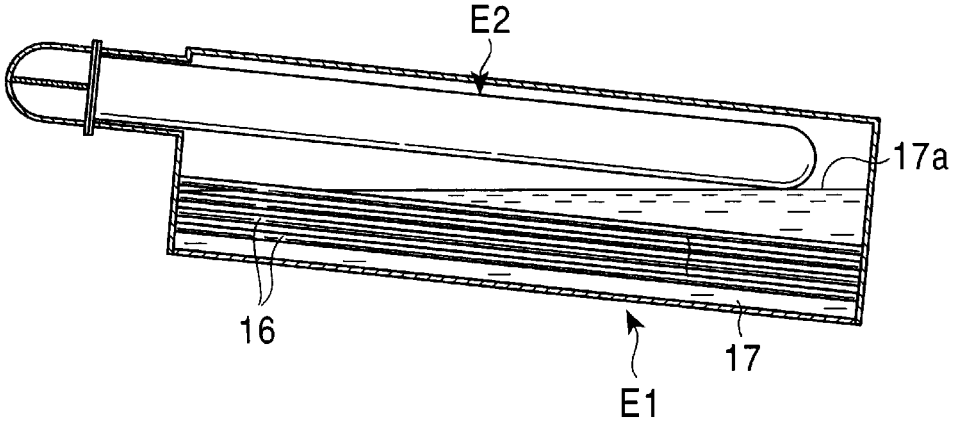
FIG. 6C PRIOR ART

By using such a vaporizer, since the intermediate fluid 17 in the lower part of the intermediate fluid evaporator E1 is divided lengthwise and widthwise by the support plates 34 and the baffles 36, even when the evaporator E1 shakes to tilt transversely (FIG. 3B) or to tilt longitudinally (FIG. 4), the level 17*a* is prevented by the support plates 34 and the baffles 36 from changing due to the shaking (the change relative to the evaporator E1 itself). Furthermore, since the right and left sides of the level 17*a* are covered with the cover plates 38, waves of the intermediate fluid 17 are inhibited from rising from both the sides, which prevents heat transfer tubes 23 from being washed over by the waves. By thus preventing the level change, it is possible to avoid the partial exposure of the heat source tubes 16 (FIGS. 6A and 6C) and the surface wetting of the heat transfer tubes 23 (FIGS. 6B and 6C) due to the level change, and to thereby maintain excellent vaporization ability.

Accordingly, this vaporizer is particularly suitable for installation on a ship or a barge plant on the sea. For example, even when there are no LNG vaporizing facilities on the land, rapid NG supply is made possible by installing the vaporizer with an LNG tank on a ship or a barge plant so as to vaporize LNG into NG and to feed the NG to an onshore consumer.

The present invention is not limited to the above-described embodiment, and for example, the following modifications are possible.

Figure 3C:
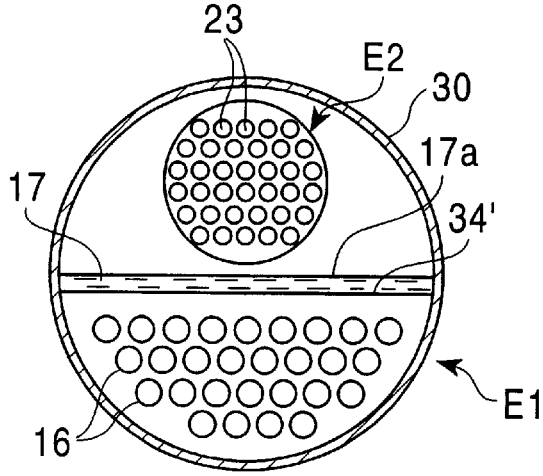
Figure 4:
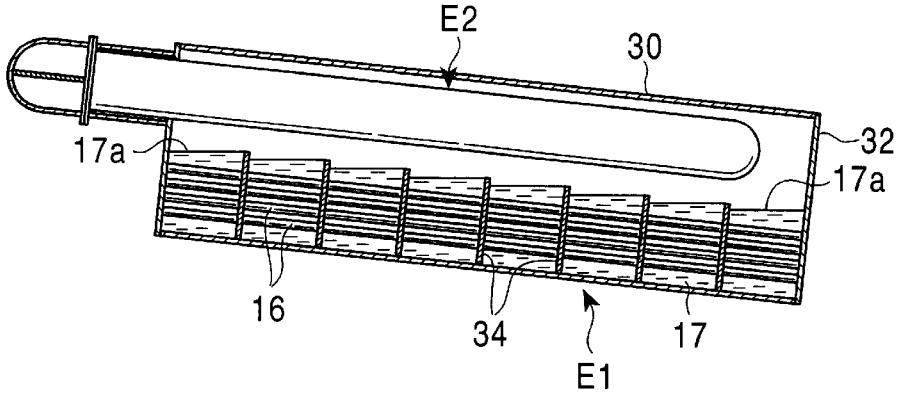
FIG. 4 is a sectional view showing a state in which the intermediate fluid evaporator is longitudinally tilted.

In the present invention, the height range, where the partition members are placed, can be freely set as long as the partition members can be in contact with the intermediate fluid. For example, the baffles 36 may be provided in an area below the level of the intermediate fluid (e.g., only at the bottom of the shell 30). When the partition members are provided in the height range including the level of the intermediate fluid, however, it is possible to more effectively restrict the level change. For example, when the support plates 34 higher than the fluid level are provided, as shown in FIG. 3A, it is, of course, possible to more effectively restrict the level change than a case in which only low support plates 34' are provided, as shown in FIG. 3C. Separate from such support plates 34, a partition member may be provided only for the purpose of restricting the level change.

While the vaporizer of the above embodiment includes all the members (support plates 34) for dividing the intermediate fluid 17 longitudinally, the members (baffles 36) for dividing the intermediate fluid 17 transversely, and the cover plates 38, even if it has only one of these members, it is possible to obtain advantages that are superior to those of the conventional vaporizer. Specific shape and number of the partition members may be appropriately determined.

In the present invention, the number and shape of the heat source tubes 16 and the heat transfer tubes 23 to be placed also do not matter. For example, the heat transfer tubes 23 may be linearly shaped to extend from one of the tubesheets 32 to the other tubesheet, instead of being U-shaped as described above. Furthermore, it may be appropriately determined whether to install equipment other than the intermediate fluid evaporator E1, e.g., the NG heater E3 shown in FIG. 5.

While the clearances between the support plates 34 and the heat source tubes 16, and small through holes formed in the baffles 36 are utilized as a means for passing the intermediate fluid 17 little by little through the partition members (i.e., a means for moving the intermediate fluid 17 below the level), for example, the partition members may be provided with a cutout at the bottom thereof, or may be fixed to the positions in the shell 30 above the bottom thereof.

While the present invention has been described with reference to what is presently considered to be the preferred embodiment, it is to be understood that the invention is not limited to the disclosed embodiment. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An intermediate fluid type vaporizer having an intermediate fluid evaporator for containing an intermediate fluid, said intermediate fluid evaporator including a heat source tube for evaporating the intermediate fluid by exchanging heat between a heat source fluid and the intermediate fluid, and a low-temperature liquid evaporating section for evaporating a low-temperature liquid by exchanging heat between the low-temperature liquid and the evaporated intermediate fluid, wherein said intermediate fluid evaporator further includes means for preventing the level of the intermediate fluid in said intermediate fluid evaporator from changing due to shaking of said intermediate fluid evaporator itself.

2. An intermediate fluid type vaporizer according to claim 1, wherein a partition member for dividing the intermediate fluid that remains in said intermediate fluid evaporator is provided in said intermediate fluid evaporator.

3. An intermediate fluid type vaporizer according to claim 2, wherein said partition member is placed within a height range including at least the level of the intermediate fluid in said intermediate fluid evaporator.

4. An intermediate fluid type vaporizer according to claim 2 or 3, wherein said partition member divides the intermediate fluid, which remains in said intermediate fluid evaporator, in the widthwise direction nearly orthogonal to the axial direction of said heat source tube.

5. An intermediate fluid type vaporizer according to claim 4, wherein said partition member is disposed at a plurality of positions arranged in the widthwise direction nearly orthogonal to the axial direction of said heat source tube.

6. An intermediate fluid type vaporizer according to claim 3, wherein said partition member divides the intermediate fluid, which remains in said intermediate fluid evaporator, in the lengthwise direction nearly parallel to the axial direction of said heat source tube.

7. An intermediate fluid type vaporizer according to claim 6, wherein said partition member is disposed at a plurality of positions arranged in the lengthwise direction nearly parallel to the axial direction of said heat source tube.

8. An intermediate fluid type vaporizer according to claim 7, wherein support plates for commonly holding a plurality of parallel heat source tubes are disposed at a plurality of positions arranged in the lengthwise direction nearly parallel to the axial direction of said heat source tubes, and said support plates are extended to a position higher than the level of the intermediate fluid in said intermediate fluid evaporator.

9. An intermediate fluid type vaporizer according to claim 1, wherein a lattice-shaped partition member is provided in said intermediate fluid evaporator to divide the intermediate fluid, which remains in said intermediate fluid evaporator, both in the lengthwise direction nearly parallel to the axial direction of said heat source tube, and in the widthwise direction nearly orthogonal to the axial direction.

10. An intermediate fluid type vaporizer according to claim 9, wherein said partition member is placed within a height range including at least the level of the intermediate fluid in said intermediate fluid evaporator.

11. An intermediate fluid type vaporizer according to any of claims 1, wherein a covering member is provided in said intermediate fluid evaporator to cover both ends of the level of the intermediate fluid that remains in said intermediate fluid evaporator.

12. A natural gas supply method using an intermediate fluid type vaporizer, wherein a liquefied natural gas tank and an intermediate fluid type vaporizer are mounted on a ship or a barge plant, and liquefied natural gas stored in said liquefied natural gas tank is supplied to the land after being vaporized by said intermediate fluid type vaporizer, wherein said intermediate fluid type vaporizer has an intermediate fluid evaporator for containing an intermediate fluid, said intermediate fluid evaporator including a heat source tube for evaporating the intermediate fluid by exchanging heat between a heat source fluid and the intermediate fluid, and a low-temperature liquid evaporating section for evaporating a low-temperature liquid by exchanging heat between the low-temperature liquid and the evaporated intermediate fluid, and wherein said intermediate fluid evaporator further includes means for preventing the level of the intermediate fluid in said intermediate fluid evaporator from changing due to shaking of said intermediate fluid evaporator itself.

13. A natural gas supply method according to claim 12, wherein a partition member for dividing the intermediate fluid that remains in said intermediate fluid evaporator is provided in said intermediate fluid evaporator.

14. A natural gas supply method according to claim 13, wherein said partition member is placed within a height range including at least the level of the intermediate fluid in said intermediate fluid evaporator.

15. A natural gas supply method according to claim 13 or 14, wherein said partition member divides the intermediate fluid, which remains in said intermediate fluid evaporator, in the widthwise direction nearly orthogonal to the axial direction of said heat source tube.

16. A natural gas supply method according to claim 15, wherein said partition member is disposed at a plurality of positions arranged in the widthwise direction nearly orthogonal to the axial direction of said heat source tube.

17. A natural gas supply method according to claim 14, wherein said partition member divides the intermediate fluid, which remains in said intermediate fluid evaporator, in the lengthwise direction nearly parallel to the axial direction of said heat source tube.

18. A natural gas supply method according to claim 17, wherein said partition member is disposed at a plurality of positions arranged in the lengthwise direction nearly parallel to the axial direction of said heat source tube.

19. A natural gas supply method according to claim 18, wherein support plates for commonly holding a plurality of parallel heat source tubes are disposed at a plurality of positions arranged in the lengthwise direction nearly parallel to the axial direction of said heat source tubes, and said support plates are extended to a position higher than the level of the intermediate fluid in said intermediate fluid evaporator.

20. A natural gas supply method according to claim 12, wherein a lattice-shaped partition member is provided in said intermediate fluid evaporator to divide the intermediate fluid, which remains in said intermediate fluid evaporator, both in the lengthwise direction nearly parallel to the axial direction of said heat source tube, and in the widthwise direction nearly orthogonal to the axial direction.

21. A natural gas supply method according to claim 20, wherein said partition member is placed within a height range including at least the level of the intermediate fluid in said intermediate fluid evaporator.

22. A natural gas supply method according to any of claims 12, wherein a covering member is provided in said intermediate fluid evaporator to cover both ends of the level of the intermediate fluid that remains in said intermediate fluid evaporator.

* * * * *